United States Patent [19]

DelSavio

[11] Patent Number: 4,919,235

[45] Date of Patent: Apr. 24, 1990

[54] FIRE EXIT SYSTEM

[76] Inventor: Eugene DelSavio, 425 Boyd St., Akron, Ohio 44305

[21] Appl. No.: 93,988

[22] Filed: Sep. 8, 1987

[51] Int. Cl.[5] ..... E06C 9/10

[52] U.S. Cl. ..... 182/18; 182/19; 182/77; 182/36; 49/31

[58] Field of Search ..... 182/18, 19, 77; 49/31

[56] References Cited

U.S. PATENT DOCUMENTS

| | | | |
|---|---|---|---|
| 3,392,380 | 7/1968 | Fordyce | 182/18 |
| 3,802,123 | 4/1974 | Frey | 49/141 |
| 3,887,033 | 6/1975 | Breinig | 182/78 |
| 4,024,928 | 5/1977 | Pickard | 182/19 |
| 4,037,685 | 7/1977 | Talucci | 182/19 |
| 4,109,759 | 8/1978 | Cundiff | 182/19 |
| 4,164,095 | 8/1979 | Mussachia | 182/19 |
| 4,539,555 | 9/1985 | Tefka | 49/31 |

*Primary Examiner*—Reinaldo P. Machado

*Attorney, Agent, or Firm*—Renner, Kenner, Greive, Bobak, Taylor & Weber

[57] ABSTRACT

A fire escape system is described in which a latched escape door in a building is unlatched by withdrawal of a restraining pin from a latch mechanism, producing automatic opening of the door by any of various door-opening self actuating means described. In one embodiment, withdrawal of the restraining means results as a consequence of the transmission of a signal generated by a fire detection device, to an electric windlass system, which thereupon retractably winds a cable attached to the pin, withdrawing it from the latch mechanism.

7 Claims, 3 Drawing Sheets

FIRE EXIT SYSTEM

This invention relates to emergency fire exit systems. More particularly, this invention relates to the provision of emergency exit doors which are automatically opened in the event of fire. Specifically, this invention relates to emergency doors secured by latches, the release of which is activated by fire detection devices, and to self actuated opening devices adapted to open the doors following the latch release.

BACKGROUND OF THE INVENTION

Each year, accidental fires cause injuries and widespread loss of life throughout the country. Most such instances occur as a consequence of building fires, and the inability of individuals to escape therefrom in a fire situation. Victims include children who are frightened or confused, or who for some reason or other are unable to exit the building. However, adults are also oftentimes injured or killed as a result of panic or a physical disability which interferes with their ability to successfully operate emergency exits. Those trapped on upper floors of buildings are particularly vulnerable in fire situations.

Domesticated animals are even more at risk from the hazard of fire since they are incapable of operating the doors of buildings in which they are confined. Furthermore, in the case of horses, unless a fire is detected in its early stages and a suitable escape means provided, it is difficult and sometimes even impossible to save the animals because of their reluctance to leave the supposed security of their stalls.

Many attempts have been made to counter the fire hazard with such things as devices which detect the presence of fire and sound an alarm, automatic door-unlocking mechanisms, audio announcement systems, emergency doors with panic bars, and many similar and different systems. U.S. Pat. No. 4,539,555 for example, even describes a detection device that senses smoke or fire and automatically unbolts a normally locked escape door. However, such a system still suffers from the fact that a panicked victim in a smoke obscured environment sometimes lacks the presence of mind required to find and operate the door release. Unfortunately, the smoke, disorientation, panic, physical infirmity of those trapped, and various other circumstances oftentimes interfere with the safe escape of humans from buildings. In the case of animals, escape is often made difficult by the number of individual stalls involved, and the time required to lead animals therefrom. Despite the numerous devices, systems and other measures commonly employed to circumvent fire hazards, the fire toll continues to rise, and it is all to obvious that a serious problem still remains.

DISCLOSURE OF THE INVENTION

In view of the preceding, therefore, a first aspect of this invention is to provide emergency exit doors that open without human intervention in the event of a fire.

A second aspect of the invention is the provision of fire detection devices that constitute part of a system which results in emergency fire exit doors opening automatically when a fire is detected.

Another aspect of the invention herein described is to provide emergency fire doors with self-energizing opening means which are free to operate when the door is unlatched.

A still further aspect of the invention is to provide unobstructed egress from a building concurrently with the detection of heat, smoke, or fire produced ionized particles.

The preceding and other aspects of this invention are obtained by a building fire escape system automatically triggered by fire, comprising in combination:

fire detection means;
at least one exit door;
exit door latch means;
exit door latch release means, and
self-actuating exit door opening means, wherein when said fire detection means is activated by fire, it generates a signal detectable by said latch release means, causing the latter means to release said exit door latch means, thereby permitting said self-actuating exit door opening means to open said exit doors, allowing emergency egress from the building through the opened doors.

Still other aspects of the invention are realized by a building fire escape system automatically triggered by a fire, comprising a smoke detection device which upon detecting smoke, transmits a detectable signal to a windlass system that detects said signal, and in response thereto, removes a locking pin from a door latch assembly mounted on an exit door by retractably winding a cable attached to said pin on a windlass, thus permitting the exit door to be opened by a self-actuated exit door opening device selected from the group consisting of:

a device comprising a door opening spring;
a device comprising a door opening counterweight, and
a device comprising a door opening pneumatic cylinder, thereby allowing emergency egress from the building through the opened exit door.

BRIEF DESCRIPTION OF THE DRAWINGS

The invention will be better understood when reference is had to the following drawings in which.

BEST MODE FOR CARRYING OUT THE INVENTION

Figure 1:
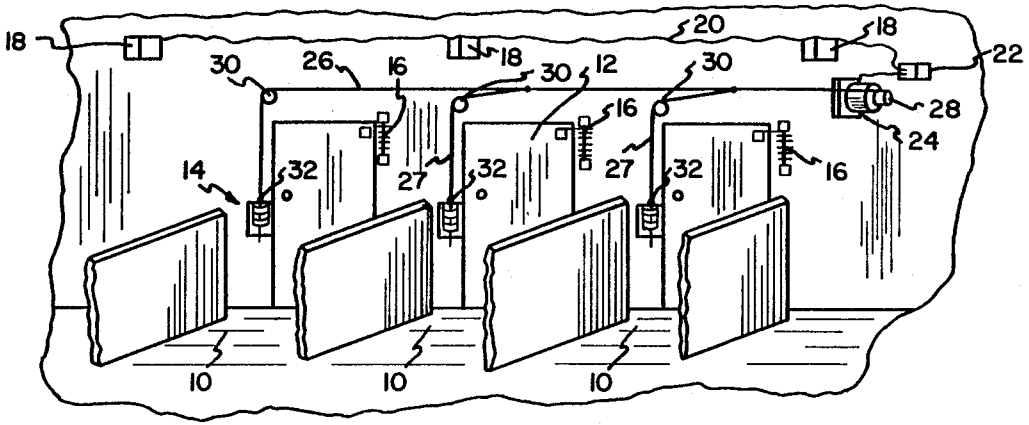
FIG. 1 is a perspective view of the fire escape system of the invention disposed in a horse barn in which a spring is used to actuate the exit doors.

FIG. 1 shows an isometric view of the fire exit system of the invention comprising stalls 10 in which horses or other livestock are confined, with exit doors 12 provided for emergency use in case of a fire, which lead out and away from the building. Exit doors 12 are normally secured by a latch means, which may take the form of a hasp 14. When hasp 14 is unsecured, the door is free to automatically open under the self-actuating influence of spring 16. In the event of a fire, a fire detection device such as a smoke detector 18 senses that a fire is in progress and conveys a signal, for example, an electrical signal through signal wire 20 to an activating device, relay switch 22 in the Figure. Relay switch 22 in turn activates an electric motor 24 attached to a windlass device such as cable spool 28 which retractably winds bolt cable 26 thereon. Bolt cable 26 is provided with lateral cables 27 which are guided over cable pulleys 30 to bolts 32, which under normal circumstances secure the exit doors 12 in a latched position. In the event of a fire, bolts 32 are withdrawn by lateral cables 27 as bolt cable 26 is wound by the windlass. While FIG. 1 contemplates generation of an electrical signal, an audible signal may also be used in conjunction with an appropriate sensing device capable of activating relay switch 22. Ordinarily, electrical energy for energizing the smoke detectors 18, and electric motor 24, will be supplied from the building's electrical supply network; however, batteries may also be used for the purpose, alone, or in conjunction with the building's electrical power supply. In addition, while the Figure shows activation of relay switch 22 by means of an electric signal originating from smoke detectors 18, the system may be wired so that the relay switch will also respond to a signal command originating other than from the smoke detectors, for example, from a central command station located elsewhere. The system may also be furnished with an audible alarm, triggered simultaneously with the opening of the exit doors 12, for the purpose of alerting those in the vicinity of the fire, as well as for stimulating animals previously confined in the stalls 10 to leave the building.

Figure 3:
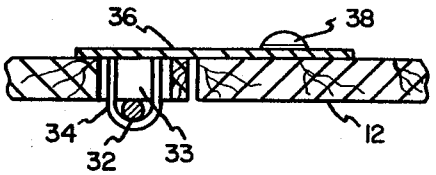
Figure 2:
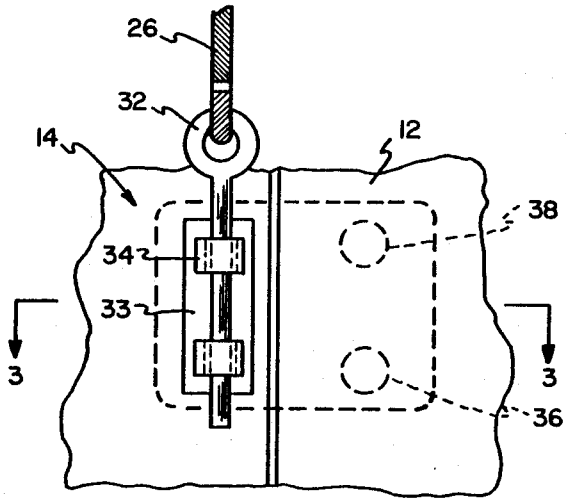
FIG. 2 is an elevation, and FIG. 3 a sectional view of an exit door latch release means of the invention.

FIG. 2 and FIG. 3 are inside and sectional views, respectively, showing details of a latch of the hasp type fastened to exit door 12 by means of lag screws 38. As shown, the hasp includes a fastening plate 36 fitted with staples 34 which extend through opening 33 when the hasp is in the closed position, and which are secured by the insertion of bolt 32, attached to bolt cable 26. If desired, a different type of latch may be substituted for the hasp type shown, and release of the latch may be accomplished by means other than withdrawal of pin 32 by means of bolt cable 26. For example, the signal generated by smoke detector 18 may activate a solonoid adapted to withdraw bolt 32. However, a cable network, such as that shown in FIG. 1, constitutes a particularly desirable latch release means.

Figure 4:
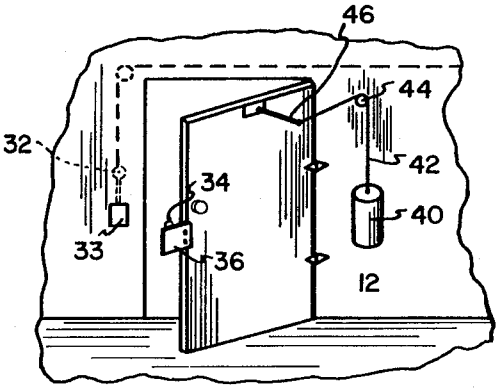
FIG. 4 is a perspective view of the outside of one of the stalls shown in FIG. 1 in which, however, a counterweight is used to actuate the exit door.

FIG. 4 is an isometric outside view of an exit door for a stall such as those shown in FIG. 1, in which, however, the self-actuating exit door opening means comprises a counterweight system, rather than spring 16. In the Figure, the exit door 12 is shown in an open position, bolt 32 having been withdrawn from the staples 34 on fastening plate 36, allowing exit door 12 to swing open. The opening of exit door 12 occurs when bolt 32 is withdrawn as a result of the action of gravity on counterweight 40, attached by counterweight cable 42. The descending weight causes a force to be applied to connecting arm 46 with the assistance of counterweight pulley 44, over which the counterweight cable 42 passes. The size of the counterweight employed will depend upon considerations such as the weight of the door, its method of suspension, the friction inherent in the door opening process, and similar factors. While the arrangement of the counterweight 40, and its associated components is simple and reliable, other counterweight actuated systems may also be used.

Figure 5:
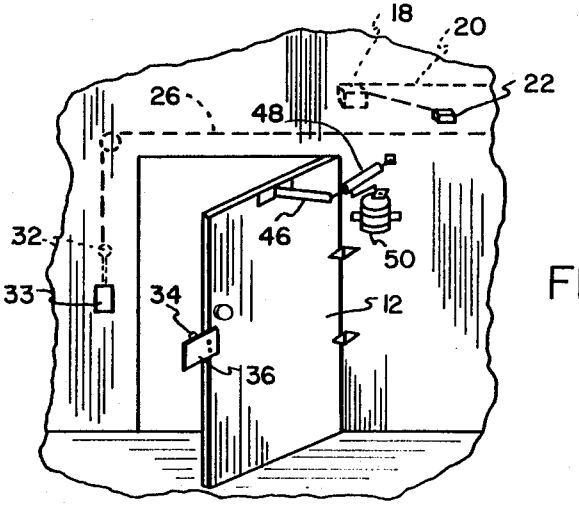
FIG. 5 is a perspective view of the outside of a stall of FIG. 1 in which, however, a pnematic cylinder is used to actuate the exit door.

FIG. 5 shows an isometric outside view of another stall of the kind illustrated in FIG. 1, in which, however, a different type of self-actuating exit door opening means is employed. In the Figure, the exit door 12 is shown in its open position, bolt 32 having been withdrawn from staples 34 on fastening plate 36. As represented, smoke or ionized particles have caused smoke detector 18 to send a signal through signal wire 20 to a windlass device, not shown, resulting in the retraction of bolt cable 26, and the withdrawal of bolt 32. Simultaneously, smoke detector 18 has sent a signal through signal wire 20 to relay switch 22, causing the latter to open a solonoid valve on gas cylinder 50. The gas cylinder 50 thus activated, retracts, and in the process opens exit door 12, as a result of the connection between the gas cylinder and connection arm 46. The fire exit system may, of course, be connected to a central air, or other gas distribution system, rather than to gas cylinder 50. In addition, air may be continuously supplied to pneumatic actuator 48, instead of being supplied only when a signal is sensed over auxilary signal wire 20.

Figure 6:
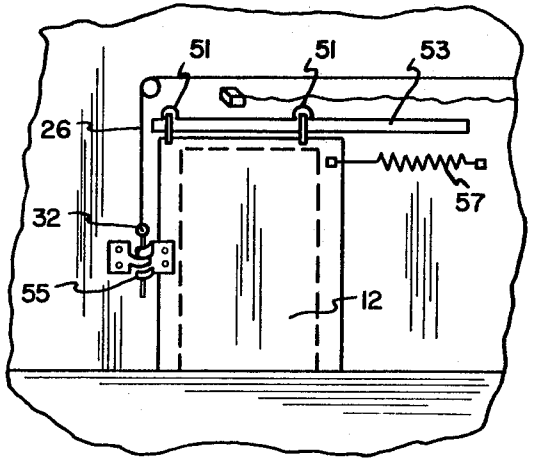
FIG. 6 is a perspective view of one of the stalls shown in FIG. 1 in which, however, a sliding exit door actuated by a spring is employed.

FIG. 6 illustrates a still further embodiment of the invention in which the exit door 12 is in the form of a slideable door hung by rollers 51 on rail 53. Pin 32 is withdrawn from a hasp type latch 55 during a fire, in the manner previously described, allowing spring 57 to open the door. If desired, door 12 may be a "pocket" type door recessed in the wall of the building, or it may take the form of an entire wall panel.

Figure 7:
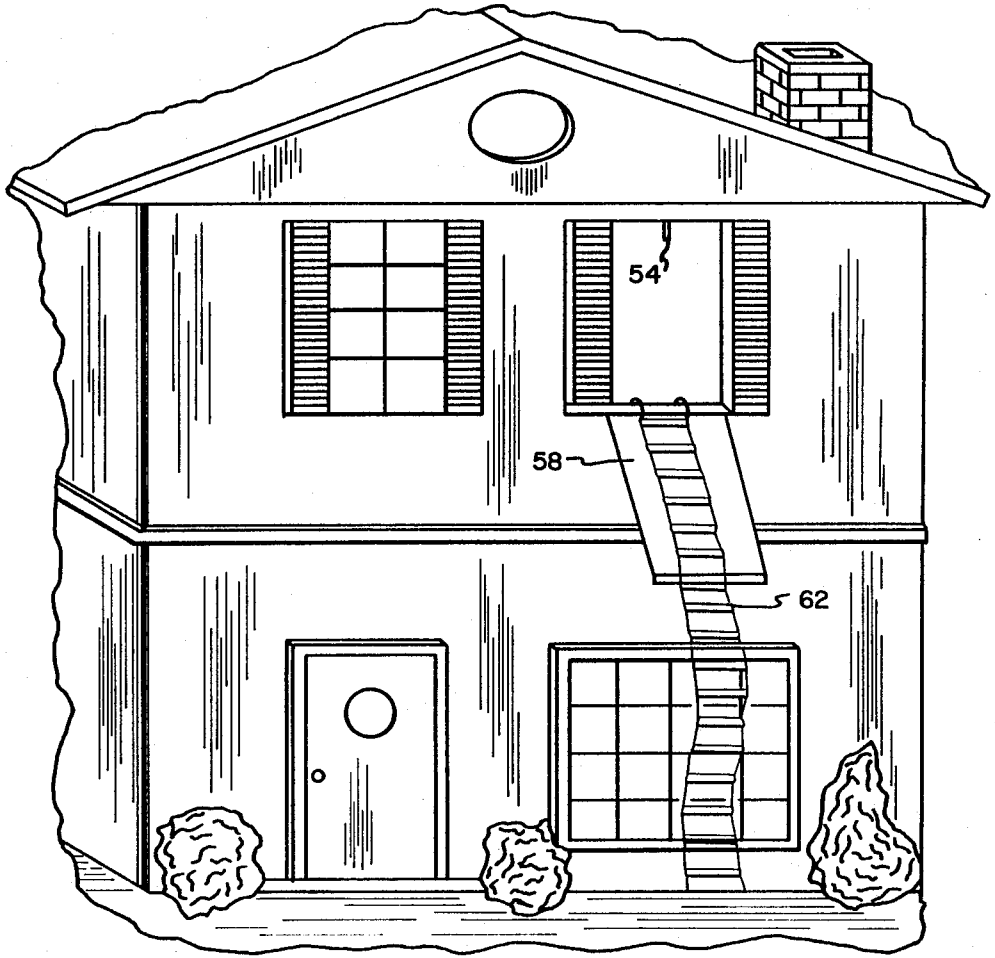
FIG. 7 is a view of a house on which an exit door of a type contemplated by the invention is shown in its deployed position.

FIG. 7 illustrates a different embodiment of the invention in which an exit door 58 is mounted in an upper story of a building, in the Figure, the second story of a house. As shown, the exit door, represented by a double hung window assembly hingably mounted at its lower edge to a window sill, has been released by the automatic withdrawal of a pin 54. Upon being released, the window pivots downward as a consequence of gravity, allowing egress from the house. While an escape ladder 62 is shown, the escape means man also consist of a chute, a rope, or similar means to allow descent to the ground.

Figure 8:
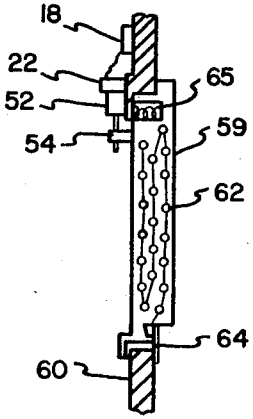
FIG. 8 is a vertical cross section of an exit door similar to that of FIG. 5, but in an undeployed position.

FIG. 8 is a cross section of an exit door 59 in the form of a hollow panel, rather than the window 58 of FIG. 7. The Figure illustrates an escape ladder 62 stored in the escape panel 59, the latter being hingably mounted by hinge 64 to outside wall 60. The release of panel 59 is accomplished as a result of a signal sent by smoke detector 18 in the event of a fire to relay switch 22, which triggers a solonoid 52, withdrawing restraining pin 54. Panel 59 is activated by gravity following withdrawal of pin 54, either as the result of an unbalanced gravitational force caused by the cantilevered configuration and suspension of the panel, which may advantageously extend beyond the front, outside building line of wall 60. Alternatively, however, panel 59 may be propelled outwardly about hinge 64 as the result of the action of spring 65, thereby exposing the panel, and any descent means stored therein, to the effects of gravity. While the Figure shows escape descent means such as ladder 62 stored within panel 59, the descent means may also be stored beneath the exit opening and deployed following release of the panel.

It will be understood that the exit doors shown, their operating mechanics, and the position and buildings in which they are installed, may all be varied without departing from the spirit of the invention disclosed herein, and that while in accordance with the patent statutes, the preferred embodiment and best mode has been presented, the scope of the invention is not limited thereto, but rather is measured by the scope of the attached claims.

What is claimed is:

1. A building fire escape system automatically triggered by a fire, comprising a smoke detection device which upon detecting smoke, transmits a detectable signal to a windlass system that detects said signal, and in response thereto, removes a locking pin from a door latch assembly mounted on an exit door by retractably winding a cable attached to said pin on a windlass, thus permitting the exit door to be opened by a self-actuating exit door opening device selected from the group consisting of:

a device comprising a door opening spring;

a device comprising a door opening counterweight, and a device comprising a door opening pneumatic cylinder, thereby allowing emergency egress from the building through the opened exit door.

2. A building fire escape system automatically triggered by a fire, comprising in combination:

fire detection means;

at least one exit door;

exit door latch means;

exit door latch release means, and self-actuating exit door opening means, wherein when said fire detection means is activated by fire, it generates a signal detectable by said latch release means, causing the latter means to release said exit door latch means, said exit door latch means comprising a latch assembly unlatched by removal of a locking pin, and said exit door latch release means comprising a windlass system which accomplishes the removal of said locking pin by retractably winding a cable attached to the pin on a windlass.

3. A fire escape system according to claim 2 in which said fire detection means is a smoke detector device which transmits a detectable signal when activated by fire.

4. A fire escape system according to claim 3 wherein said signal is received by an electric motor driven windlass system that includes an electric relay capable of detecting said signal, said relay responding to such detection by activating an electric motor connected to said windlass which retractably winds a cable attached to said locking pin on the windlass, thereby removing said pin so as to unlatch said exit door latch means.

5. A fire escape system according to claim 2 in which said self-actuating exit door opening means is a member selected from the group of devices including:

a device comprising a door opening spring;

a device comprising a door opening counterweight, and a device comprising a door opening pneumatic cylinder.

6. A fire escape system according to claim 2 in which said fire escape system is located in a building housing animals separately confined in stalls, each stall having its own exit door, said system being activated by fire so as to release and open said exit doors simultaneously, thereby permitting the animals to escape.

7. A building fire escape system triggered during a fire, comprising in combination:

fire detection means;

at lease one exit door;

exit door latch means;

exit door latch release means, and self-actuating exit door opening means, wherein said exit doors are hinged at their lower edge, and are located in the outside wall of the upper floor of a building, and wherein further, said exit door latch means comprises an assembly unlatched by removal of a locking pin, while said exit door latch release means comprises a solonoid system which when activated accomplishes removal of said locking pin by electromagnetism, said solonoid system being activated during a fire by an electrical signal received from said fire detection means, or through a manually operated electrical supply switch, and wherein still further, said self-actuating exit door opening means operates as a result of an unbalanced gravitational force on the unlatched exit door, and said exit door contains an escape descent means automatically deployed by gravity.

* * * * *